United States Patent [19]

Matejec et al.

[11] Patent Number: 4,963,465

[45] Date of Patent: Oct. 16, 1990

[54] COLOR PHOTOGRAPHIC NEGATIVE RECORDING MATERIAL

[75] Inventors: Reinhart Matejec; Ralf Büscher, both of Leverkusen; Hans Langen, Bonn, all of Fed. Rep. of Germany

[73] Assignee: Agfa-Gevaert Aktiengesellschaft, Leverkusen, Fed. Rep. of Germany

[21] Appl. No.: 458,140

[22] Filed: Dec. 28, 1989

[51] Int. Cl.[5] ..... G03C 1/46

[52] U.S. Cl. ..... 430/506; 430/505; 430/503; 430/509

[58] Field of Search ..... 430/506, 509, 505, 503

[56] References Cited

U.S. PATENT DOCUMENTS

| | | | |
|---|---|---|---|
| 3,620,747 | 11/1971 | Marchant et al. | 430/571 |
| 3,726,681 | 4/1973 | Pankow et al. | 430/506 |
| 4,170,479 | 10/1979 | Usami | 430/957 |
| 4,348,474 | 9/1982 | Scheerer et al. | 430/506 |
| 4,571,378 | 2/1986 | Sauerteig et al. | 430/506 |
| 4,777,122 | 10/1988 | Beltramini | 430/506 |
| 4,804,619 | 2/1989 | Yamada et al. | 430/506 |

FOREIGN PATENT DOCUMENTS

| | | | |
|---|---|---|---|
| 0107112 | 2/1984 | European Pat. Off. | 430/509 |

*Primary Examiner*—Paul R. Michl
*Assistant Examiner*—Thomas R. Neville
*Attorney, Agent, or Firm*—Connolly and Hutz

[57] ABSTRACT

Using a color photographic negative recording material which contains a most sensitive, a medium-sensitive and a least sensitive silver halide part layer for recording light from at least one of the spectral ranges of red, green and blue, at least one of the two more sensitive part layers containing a DIR coupler and the most sensitive partial layer and the least sensitive part layer containing a color coupler which couples faster than the color coupler in the medium-sensitive part layer by a factor of at least 1.5, the sharpness can be improved without impairing the color grain.

5 Claims, No Drawings

COLOR PHOTOGRAPHIC NEGATIVE RECORDING MATERIAL

The invention relates to a colour photographic negative recording material which contains at least three silver halide emulsion port layers of different sensitivity containing colour couplers, for recording light from at least one of the spectral ranges of red, green and blue, the colour couplers contained in the most sensitive part layer and in the least sensitive part layer coupling faster than the colour coupler in the medium-sensitive part layer.

It is known (e.g. from DE-A-1 958 703) that in colour negative recording materials built up in double layers, that is to say recording materials which have two photosensitive silver halide emulsion part layers containing colour couplers for the same spectral range, the sensitivity and grain can be improved if the colour coupler in the more sensitive part layer couples two to twenty times faster than the colour coupler in the less sensitive part layer. Recording material which contain three or more part layers of different sensitivity for the same spectral range are also known. It is furthermore known that the sharpness and grain can be favourably influenced by using DIR couplers, even in materials with two or more part layers.

It should thus be expected that particularly favourable results are to be achieved in recording materials having three part layers for the same spectral range if colour couplers are selected for the three part layers according to their relative rate of coupling and are arranged such that the decreasing sensitivity of the individual part layers corresponds to a decreasing relative coupling rate of the colour couplers contained therein.

It has now been found, surprisingly, that thinner layers and therefore improved sharpness are achieved, without disadvantages to the grain, if a colour coupler which couples faster than the colour coupler in the medium-sensitive part layer is used in the least sensitive part layer as well as in the most sensitive part layer.

The invention relates to a colour photographic negative recording material containing at least one red-sensitive, at least one green-sensitive and at least one blue-sensitive silver halide emulsion layer, each with assigned colour couplers for producing image dyestuffs complementary to the spectral sensitivity, at least three part layers of different sensitivity being present for recording light from at least one of the spectral ranges of red, green and blue, that is to say a most sensitive, a medium-sensitive and a least sensitive part layer, at least one of the two more sensitive part layers containing a DIR compound, characterized in that the most sensitive and the least sensitive part layer each contain at least one colour coupler which couples faster than the colour coupler in the medium-sensitive part layer by a factor of at least 1.5 (preferably by a factor of at least 2).

If colour photographic recording materials for recording light from one or more of the three main spectral ranges contain three or more part layers of different sensitivity, these are as a rule arranged so that the sensitivity thereof becomes greater the more removed they are from the common layer support. Each of the different part layers which belong spectrally to one another can be assigned colour couplers, and in particular these colour couplers can be identical or different. The colour couplers are usually chosen in respect of their coupling reactivity, so that couplers which couple faster are used in a more sensitive part layer and couplers which couple more slowly are used in a less sensitive part layer (DE-A-1 958 709). The recording material according to the invention deviates from this rule to the extent that a colour coupler which, compared with the colour coupler in the middle medium-sensitive part layer, couples not more slowly but faster is used in the least sensitive part layer. According to the present invention, the colour coupler contained in the least sensitive part layer and also that contained in the most sensitive part layer couples faster than the colour coupler contained in the middle medium-sensitive part layer by a factor of at least 1.5, preferably by a factor of at least 2.0. In mentioning the coupling rate, reference is made to a relative coupling rate constant k, which can be determined by a method described in DE-A-27 04 707.

The terms "fast", "faster", "slow", "slower" used in the present connection are to be understood in the relative sense, and in particular in each case in relation to corresponding couplers of the same function in another part layer of the same spectral sensitivity. The relative coupling rate constant mentioned is a measure of the coupling rate mentioned; it is stated below in the unit $10^4.L.mol^{-1}.s^{-1}$.

The relationship required according to the invention between the coupling rates of couplers in the various part layers of the same spectral sensitivity applies above all to the colour couplers and in particular to colourless colour couplers. Progressive colour photographic recording materials moreover contain couplers with other functions, for example so-called mask couplers and so-called DIR couplers. In order to be able to cooperate to the optimum with the actual colour couplers, these couplers, which are not limited to colour generation alone, should as far as possible not differ from the colour couplers in relative coupling rate by a factor of more than 5, and preferably of not more than 2. It is thus advantageous and therefore preferred if not only the colourless colour couplers in the least sensitive part layer but also other couplers contained in this part layer, e.g. a mask coupler, have a faster coupling rate or at least do not have a considerably slower coupling rate than the corresponding couplers in the middle medium-sensitive part layer.

If faster couplers are used in the least sensitive part layer, the sharpness can surprisingly be improved without impairment of the grain, and at the same time the amount of silver halide can be reduced, especially in the least sensitive part layer, which likewise has a favourable effect on the sharpness.

It is also advantageous if the colour coupler contained in the least sensitive part layer couples not only faster than the colour coupler contained in the middle medium-sensitive part layer but also additionally faster than the colour coupler in the most sensitive part layer. In order to achieve a good (low) colour grain, especially in the image parts of lower colour density (in the negative), it may also be advantageous for the same (fast) colour coupler or different colour couplers with approximately the same (high) coupling rate to be used in the most sensitive part layer and in the least sensitive part layer, and furthermore for a colour coupler having a lower coupling rate to be admixed in an amount of up to 90 mol %, based on the total coupler content in the most sensitive part layer, to the fast colour coupler in the most sensitive part layer.

The recording materials according to the invention contain at least one DIR coupler in the medium-sensitive part layer and/or in the most sensitive part layer of a layer combination consisting of at least three part layers of the same spectral sensitivity. The use of DIR couplers and the advantages which can be achieved with these concerning interimage effects and edge effects, such as improved colour reproduction and sharpness, are known. The inhibitors released from the DIR couplers can have a low difusibility ($D<0.4$) or high diffusibility ($D\geqq 0.4$). The DIR couplers can also be employed as a mixture of two or more DIR couplers. Methods for the measurement of the diffusibility are described, for example, in EP-A-0 101 621 and DE-A-37 36 048.

It is particularly advantageous for the least sensitive part layer to contain no DIR coupler.

Examples of colour couplers, mask couplers and DIR couplers with which the invention can be realized are given below with their coupling rate constant k [$10^4$.L.mol$^{-1}$.s$^{-1}$]. The diffusibility of the inhibitor released is also stated for the DIR couplers. However, the invention is not limited to the coupler examples given.

| Cyan couplers | | k [$10^4$.l.mol$^{-1}$.s$^{-1}$] |
|---|---|---|
| C-1 | 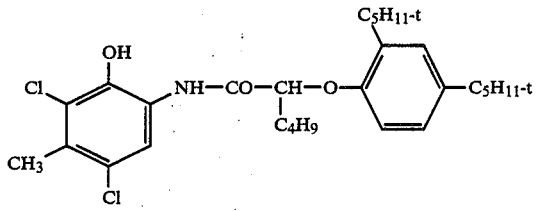 | 0.14 |
| C-2 | 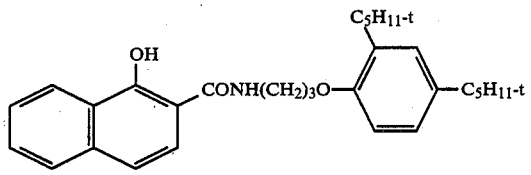 | 0.66 |
| C-3 | 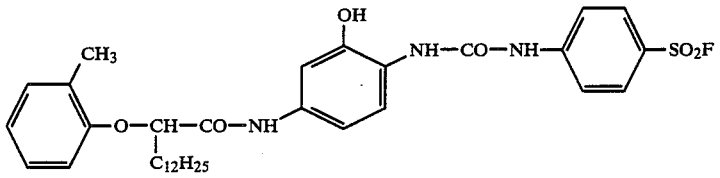 | 3.2 |
| C-4 | 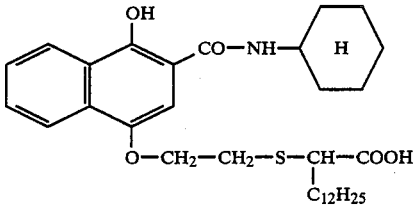 | 7.0 |
| C-5 | 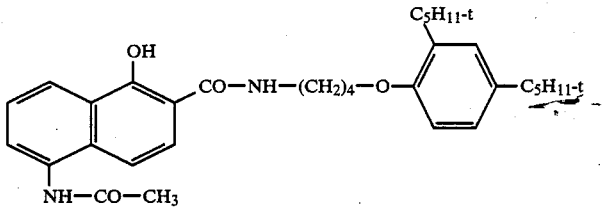 | 8.5 |
| C-6 | 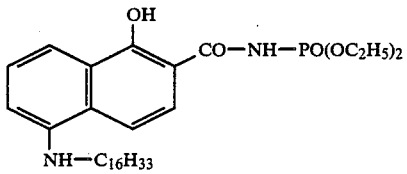 | 2.75 |

-continued
C-7 7.2
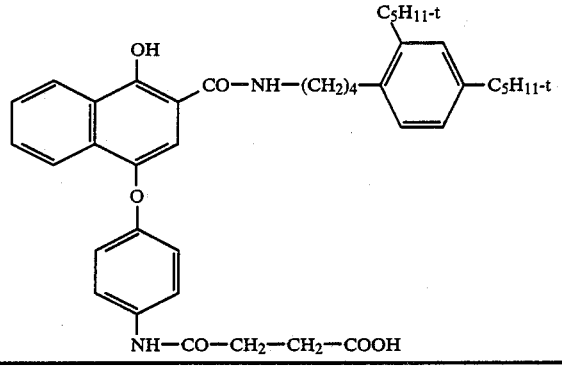
| Magenta couplers | k [$10^4$.l.mol$^{-1}$.s$^{-1}$] |
|---|---|
| M-1 | 1.4 |
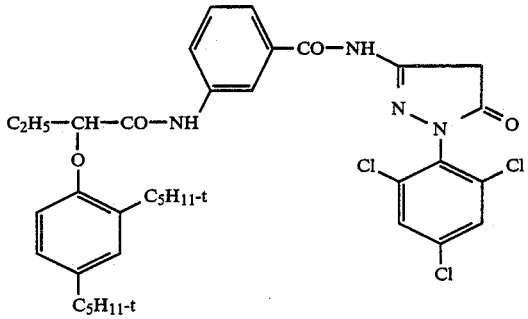
M-2 1.8
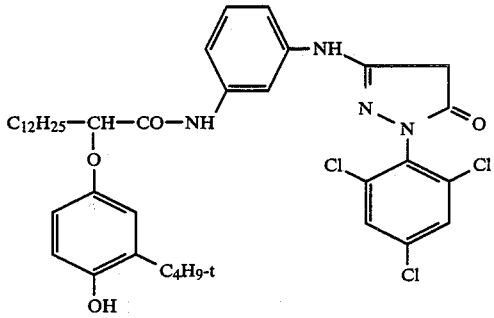
M-3 1.9
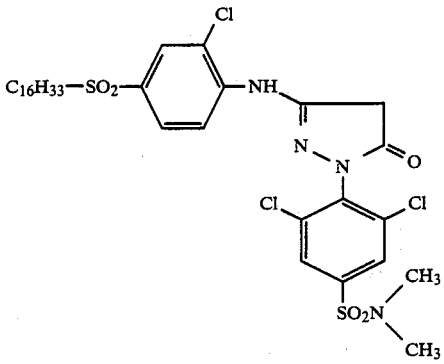
M-4 4.3
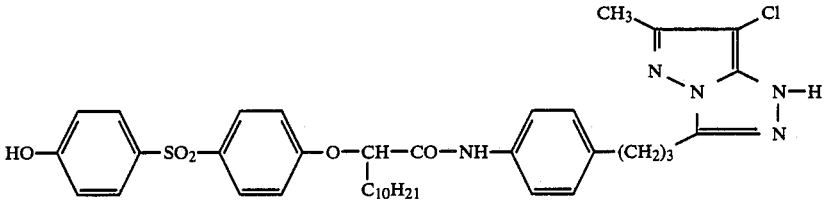

-continued
M-5
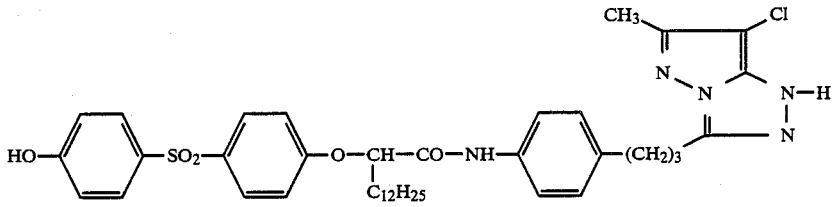
6.7
M-6
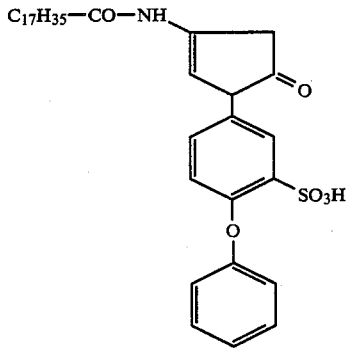
7.0
M-7
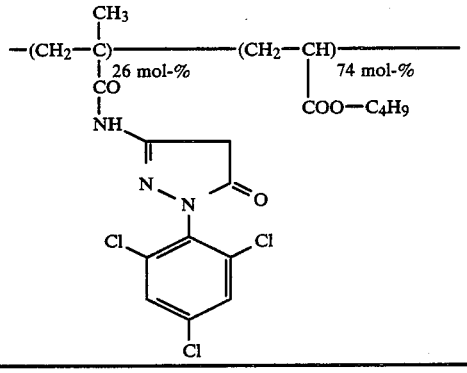
13
| Yellow couplers | k [$10^4$.l.mol$^{-1}$.s$^{-1}$] |
|---|---|
| Y-1 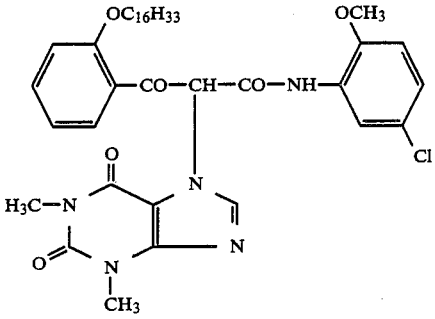 | 1.2 |
| Y-2 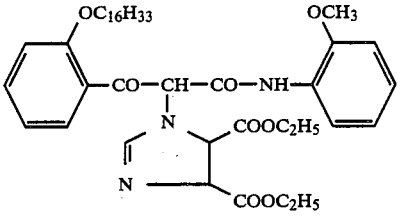 | 1.2 |

-continued
Y-3
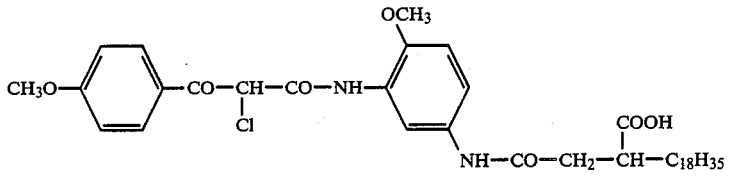
2.8
Y-4
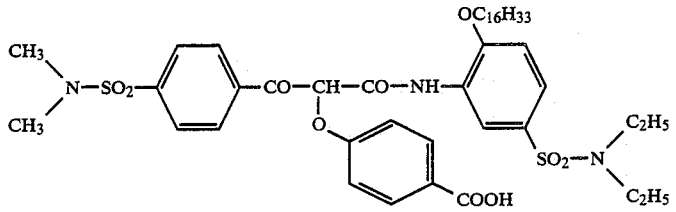
4.4
Y-5
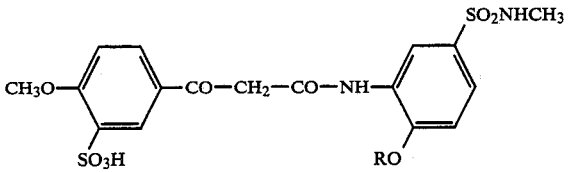
5.0
R = $C_{16}H_{33}$
$C_{18}H_{37}$
7:3
Y-6
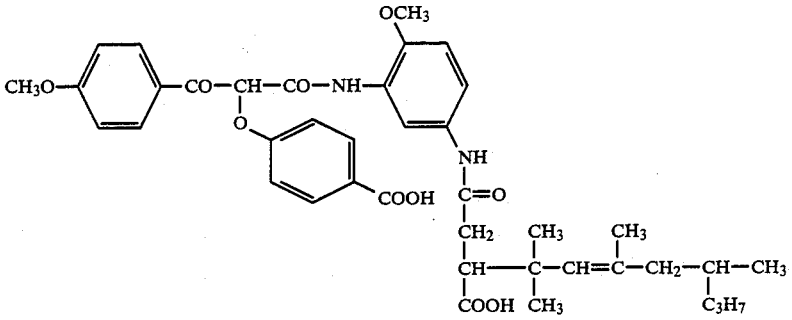
7.0
| Red masks | k [$10^4$.l.mol$^{-1}$.s$^{-1}$] |
|---|---|
| RM-1 | 0.8 |
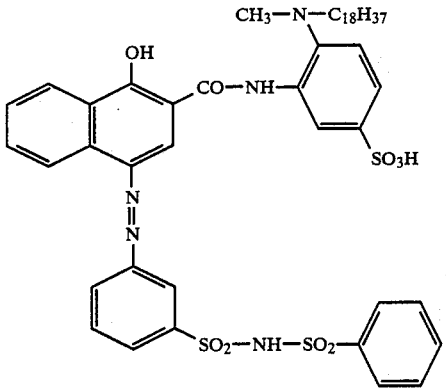

-continued
RM-2
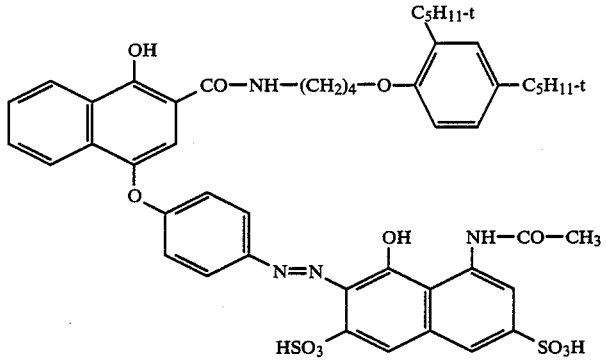
3.5
| Yellow masks | k [$10^4$.l.mol$^{-1}$.s$^{-1}$] |
|---|---|
YM-1
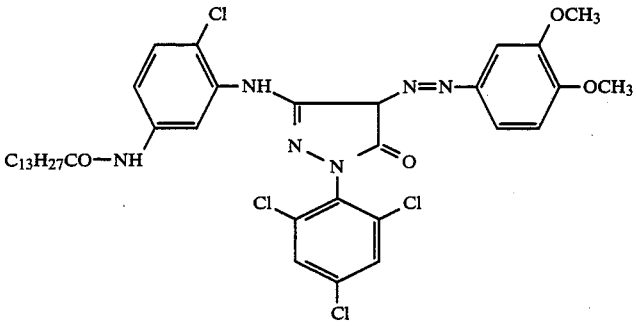
1.2
YM-2
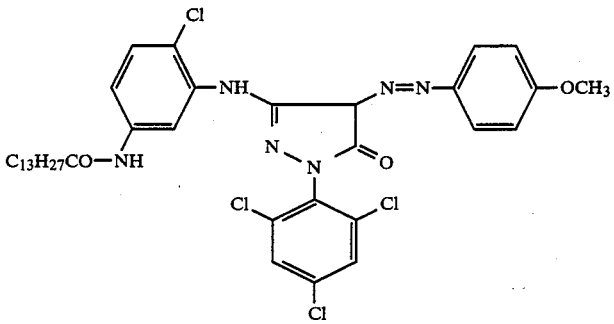
1.4
YM-3
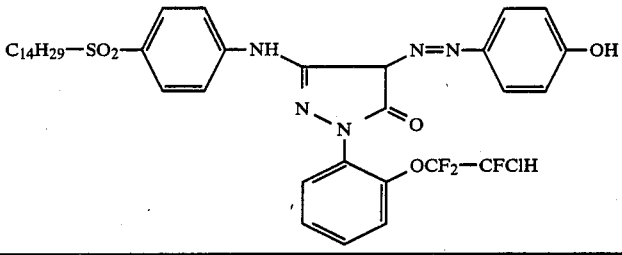
3.0
| DIR couplers | k [$10^4$.l.mol$^{-1}$.s$^{-1}$] (D = diffusibility) |
|---|---|

-continued
DIR-1
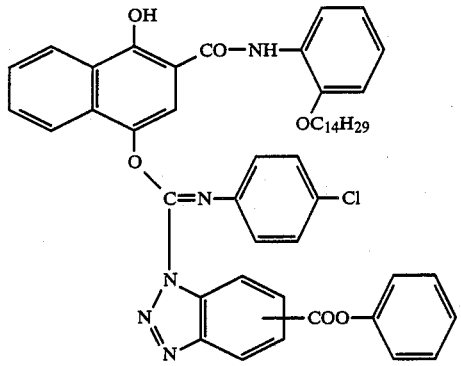
0.9
(D = 0.70)
DIR-2
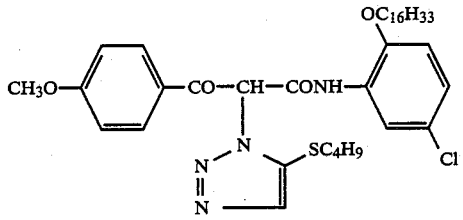
1.1
(D = 0.67)
DIR-3
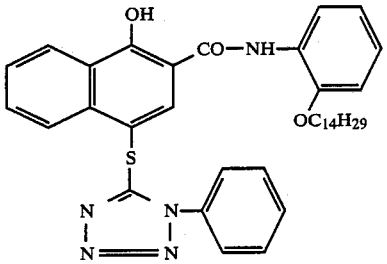
1.4
(D = 0.08)
DIR-4
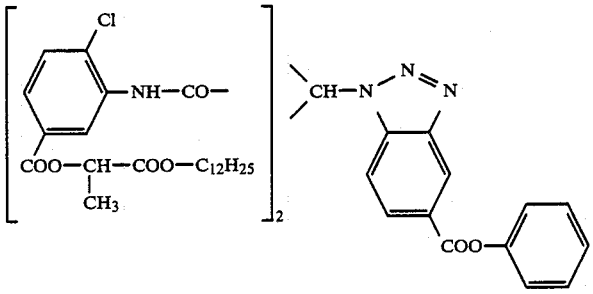
1.5
(D = 0.70)
DIR-5
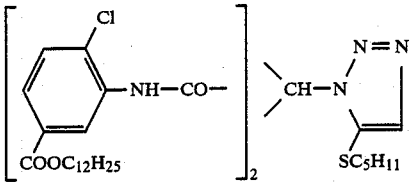
1.5
(D = 0.45)
DIR-6
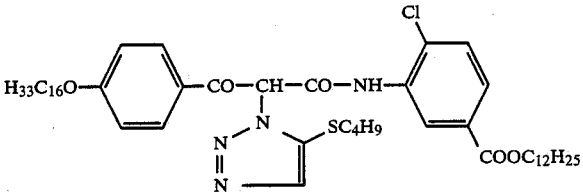
2.8
(D = 0.67)

-continued

DIR-7

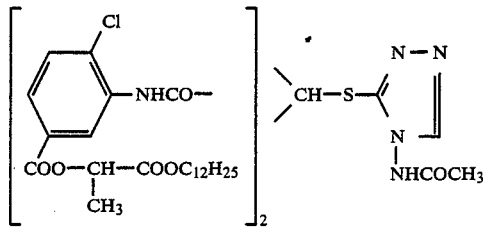

4.2
(D = 0.85)

DIR-8

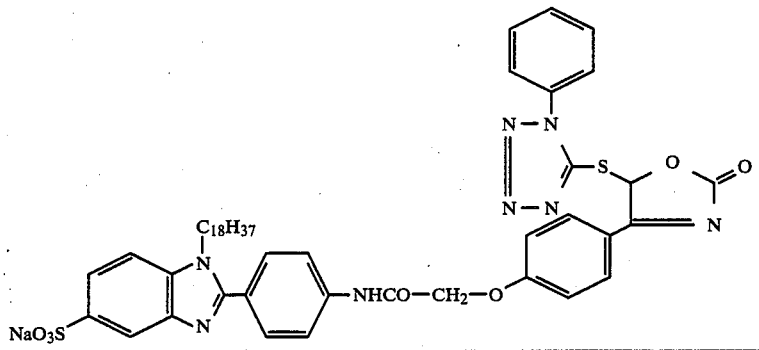

5.0
(D = 0.08)

The recording material according to the invention contains a large number of silver halide emulsion layers of different spectral sensitivity on a transparent layer support, including at least three silver halide emulsion layers of the same or approximately the same spectral sensitivity, called part layers in the present connection. These three part layers can be immediately adjacent to one another or also separated from one another by one or more layers, if appropriate of different spectral sensitivity. At least one such layer combination of three part layers of the same spectral sensitivity has the features according to the invention, which are essentially that the least sensitive part layer, like the most sensitive part layer, contains a colour coupler which couples faster than the colour coupler in the medium-sensitive layer of the same spectral sensitivity by a factor of least 1.5, at least one of the two more sensitive part layers of the same spectral sensitivity containing a DIR coupler and, preferably, the least sensitive part layer containing no DIR coupler. Such a large number of part layers, each consisting of a least sensitive part layer, a medium-sensitive part layer and a most sensitive part layer having the features according to the invention for each of the three spectral ranges of blue, green and red, is advantageously present.

With the aid of the invention, it is possible, without impairing colour reproduction and colour grain, to reduce the total silver halide content of the colour photography recording material, expressed by the equivalent amount of $AgNO_3$, to not more than 10 g $AgNO_3$, preferably not more than 9 g $AgNO_3$ per $m^2$ and in this way to improve the sharpness.

The silver halide present as the photosensitive constituent in the photographic recording material can contain chloride, bromide or iodide or mixtures thereof as the halide. For example, the halide content of the silver halide in a photosensitive layer can consist to the extent of 0 to 15 mol % of iodide, to the extent of 0 to 10 mol % of chloride and to the extent of 0 to 100 mol % of bromide. These can be predominantly compact silver halide crystals which e.g. are regularly cubic or octahedral or exhibit transition forms. Homodisperse emulsions or mixtures therefrom in at least one layer are preferred.

The silver halide grains can also have a multi-layered grain structure in the simplest case with an inner and an outer grain region (core/shell), the halide composition and/or other modifications, such as e.g. doping of the individual grain regions, varying. The average grain size of the emulsions is preferably between 0.2 μm and 2.0 μm, and the grain size distribution can be either homodisperse or heterodisperse. Homodisperse grain size distribution means that 95% of the grains deviate from the average grain size by not more than ±30%.

It is also possible to use two or more types of silver halide emulsions, which are prepared separately, as a mixture.

Gelatin is preferably used as the binder for the photosensitive and nonphotosensitive layers. However, this can be replaced completely or partly by other synthetic, semi-synthetic or naturally occurring polymers. Examples of synthetic gelatin substitutes are polyvinyl alcohol, poly-N-vinylpyrrolidone, polyacrylamides, polyacrylic acid and derivates thereof, in particular copolymers thereof. Examples of naturally occurring gelatin substitutes are other proteins, such as albumin or casein, polysaccharides, cellulose, sugars, starch or alginates. Semi-synthetic gelatin substitutes are as a rule modified naturally occurring products. Cellulose derivates, such as hydroxyalkylcellulose, carboxymethylcellulose and phthaloylcellulose, and gelatin derivatives which have been obtained by reaction with alkylating or acylating agents or by grafting on polymerizable monomers are examples of these.

The binders should have a sufficient amount of functional groups, so that sufficiently resistant layers can be produced by reaction with suitable hardening agents. Such functional groups are, in particular, amino groups, and also carboxyl groups, hydroxyl groups and active methylene groups.

The gelatin preferably used can be obtained by acid or alkaline breakdown. It is also possible to use oxidized gelatin. The preparation of such gelatins is described, for example, in The Science and Technology of Gelatin, published by A. G. Ward and A. Courts, Academic Press 1977, page 295 et seq. The particular gelatin employed should contain the smallest possible content of photographically active impurities (inert gelatin). Gelatins of high viscosity and low swelling are particularly advantageous.

The silver halide emulsion is in general subjected to chemical sensitization under defined conditions—pH, pAg, temperature and gelatin, silver halide and sensitizer concentration—until the optimum sensitivity and fog has been achieved. The procedure is described e.g. in H. Frieser "Die Grundlagen der Photographischen Prozesse mit Silberhalogeniden (The Principles of Photographic Processes using Silver Halides)" page 675–734, Akademische Verlagsgesellschaft (1968).

The photographic emulsions can contain compounds to prevent fogging or to stabilize the photographic function during production, storage or photographic processing.

The photographic emulsions can be sensitized spectrally using methine dyestuffs or other dyestuffs. Particularly suitable dyestuffs are cyanine dyestuffs, merocyanine dyestuffs and complex merocyanine dyestuffs.

A review of the polymethine dyestuffs which are suitable as spectral sensitizers, suitable combinations thereof and super-sensitizing combinations is contained in Research Disclosure 17643/1978 in Section IV.

Sensitizers can be dispensed with if the intrinsic sensitivity of the silver halide is sufficient for a certain spectral range, for example the blue sensitivity of silver bromides.

Non-diffusing monomeric or polymeric colour couplers are assigned to the emulsion layers of various sensitivities and can be in the same layer or in a layer adjacent thereto. Usually, cyan couplers are assigned to the red-sensitive layers, magenta couplers to the green-sensitive layers and yellow couplers to the blue-sensitive layers.

Colour couplers for producing the cyan part colour image are as a rule couplers of the phenol or α-naphthol type. Derivatives of ureidophenols or 1,5-aminonaphthols are preferably used.

Colour couplers for producing the magenta part colour image are as a rule couplers of the 5-pyrazolone, the acylaminopyrazolone, the indazolone or the pyrazoloazole type.

Colour couplers for producing the yellow part colour image are as a rule couplers containing an open-chain ketomethylene grouping; in particular couplers of the α-acetylacetamide type; suitable examples of these are α-benzoylacetanilide couplers and α-pivaloylacetanilide couplers.

The colour couplers can be 4-equivalent couplers or 2-equivalent couplers. The latter are derived from the 4-equivalent couplers in that they contain in the coupling position a substituent which is split off during coupling. The 2-equivalent couplers include those which are colourless, and also those which have an intense intrinsic colour which disappears or is replaced by the colour the image dyestuff produced during colour coupling (mask couplers), and the white couplers, which give essentially colourless products during reaction with colour developer oxidation products. The 2-equivalent couplers furthermore include those couplers which contain in the coupling site a radical which can be split off and which is released during reaction with colour developer oxidation products and in this way displays a certain desired photographic activity, e.g. as a development inhibitor or accelerator, either directly or after one or more other groups have been split off from the radical primarily split off (e.g. DE-A-27 03 145, DE-A-28 55 697, DE-A-31 05 026 and DE-A-33 19 428). Examples of such 2-equivalent couplers are the known DIR couplers and also DAR and FAR couplers.

DIR couplers which release development inhibitors of the mercapto type, e.g. 1-phenyl-5-mercaptotetrazole, are described, for example, in U.S. Pat. Nos. 3,227,554 and 3 632 345.

DIR couplers which release development inhibitors of the azole type, e.g. triazoles and benzotriazoles, are described in DE-A-24 14 006, 26 10 546, 26 59 417, 27 54 281, 27 26 180, 36 26 219, 36 30 564, 36 36 824, 36 44 416, and 28 42 063 and EP-A-0 272 573. Other advantages for colour reproduction, e.g. colour separation and colour purity, and for detail reproduction, e.g. sharpness and grain, can be achieved with those DIR couplers which e.g. split off the development inhibitor not directly as a consequence of the coupling with an oxidized colour developer but only after a further secondary reaction, which is achieved, for example, with a time control group. Examples of these are described in DE-A-28 55 697, 32 99 671, 38 18 231 and35 18 797, in EP-A-0 157 146 and 0 204 175, in U.S. Pat. No. 4,146,396 and 4,438,393 and in GB-A-2 072 363.

DIR couplers which release development inhibitors of high diffusibility ($D \geqq 0.4$) are described, for example, in EP-A-0 101 621 and DE-A-37 36 048.

The radical which can be split off can also be a ballast radical, so that coupling products which are capable of diffusion or have at least a weak or limited mobility are obtained during the reaction with colour developer oxidation products (U.S. Pat. No. 4,420,556).

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and U.S. 4,080,211. The high molecular weight colour couplers are as a rule prepared by polymerization of ethylenically unsaturated monomeric colour couplers. However, they can also be obtained by polyaddition or polycondensation.

The couplers or other couplers can be incorporated into silver halide emulsion layers and other layers by first preparing a solution, a dispersion or an emulsion of the compound in question and then adding this to the casting solution for the layer in question. The choice of suitable solvent or dispersing agent depends on the particular solubility of the compound.

Methods for incorporation of compounds which are essentially insoluble in water by grinding processes are described, for example, in DE-A-26 09 741 and DE-A-26 09 742.

Hydrophobic compounds can also be introduced into the casting solution using high-boiling solvents, so-called oil-formers. Corresponding methods are described, for example, in U.S. Pat. Nos. 2,322,027, 2,801,170, 2,801,171 and EP-A-0 043 037.

Instead of the high-boiling solvents, oligomers or polymers can also be used as the so-called polymeric oil-formers.

The compounds can also be introduced into the casting solution in the form of charged latices. Reference is made, for example, to DE-A-25 41 230, DE-A-25 41

274, DE-A-28 35 856, EP-A-0 014 921, EP-A-0 069 671, EP-A-0 130 115 and U.S. Pat. No. 4 291 113.

Suitable oil-formers are e.g. alkyl phthalates, phosphonic ac esters, phosphoric acidesters, citric acid esters, benzoic acidesters, amides, fatty acid esters, trimesic acid esters, alcohols, phenols, aniline derivatives and hydrocarbons.

Examples of suitable oil-formers are dibutyl phthalate, dicyclohexyl phthalate, di-2-ethylhexyl phthlate, decyl phthalate, triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexyl phenyl phosphate, 2-ethylhexyl benzoate, dodecyl benzoate, 2-ethylhexyl p-hydroxybenzoate, diethyldodecanamide, N-tetradecylpyrrolidone, isostearyl alcohol, 2,4-di-t-amylphenol, dioctyl acetate, glycerol tributyrate, isostearyl lactate, trioctyl citrate, N,N-dibutyl-2-butoxy-5-t-octylaniline, paraffin, dodecylbenzene and diisopropylnaphthalene.

The non-photosensitive intermediate layers as a rule positioned between layers of different spectral sensitivity can contain agents which prevent undesirable diffusion of developer oxidation products from one photosensitive into another photosensitive layer of different spectral sensitization.

Suitable agents, which prevent undesirable diffusion of developer oxidation products and which are also called scavengers, are described in Research Disclosure 17 643 (Dec. 1978), chapter VII, 17 842 (Feb. 1979) and 18 716 (Nov. 1979), page 650 and in EP-A-0 06 070, 0 098 072, 0 124 877 and 0 125 522.

The photographic recording material can furthermore contain compounds which absorb UV light, whiteners, spacers, filter dyestuffs, formalin collectors, light stabilizers, antioxidants, $D_{min}$ dyestuffs, additives for improving the dyestuff, coupler and white stabilization and for reducing the colour fog, plasticizers (latices) and biocides.

Compounds which absorb UV light should on the one hand protect the image dyestuffs from bleaching by UV-rich daylight and on the other hand, as filter dyestuffs, absorb the UV light in daylight during exposure, and in this way improve the colour reproduction of a film. Compounds of different structure are usually employed for the two tasks. Examples are aryl-substituted benzotriazole compounds (U.S. Pat. No. 3,533,794), 4-thiazolidone compounds (U.S. Pat. No. 3 314 794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3 700,455).

It is also possible to use ultraviolet-absorbing couplers (such as cyano couplers of the $\alpha$-naphthol type) and ultraviolet-absorbing polymers. These ultraviolet-absorbing agents can be fixed by mordanting in a special layer.

Filter dyestuffs which are suitable for visible light include oxonol dyestuffs, hemioxonol dyestuffs, styryl dyestuffs, merocyanine dyestuffs, cyanine dyestuffs and azo dyestuffs. Of these dyestuffs, oxonol dyestuffs, hemioxonol dyestuffs and merocyanine dyestuffs are particularly advantageously used.

Suitable whiteners are described e.g. in Research Disclosure 17 643 (Dec. 1978), chapter V, in U.S. Pat. Nos. 2,632,701 and 3,269,840 and in GB-A-852 075 and 1 319 763.

Certain binder layers, in particular the layer furthest removed from the support, but also occasionally intermediate layers, especially if they are the layer furthest removed from the support during preparation, can contain photographically inert particles of an inorganic or organic nature, e.g. as matting agents or as spacers (DE-A-33 31 542, DE-A-34 24 893 and Research disclosure 17 643 (Dec. 1978), chapter XVI).

The average particle diameter of the spacers is in particular in the range from 0.2 to 10 $\mu$m. The spacers are water-insoluble and can be alkali-insoluble or alkali-soluble, the alkali-soluble spacers in general being removed from the photographic material in the alkaline development bath. Examples of suitable polymers are polymethyl methacrylate, copolymers of acrylic acid and methyl methacrylate and hydroxypropylmethylcellulose hexahydrophthalate.

Additives for improving the dyestuff, coupler and white stability and for reducing the colour fog (Research Disclosure 17 643 (Dec.1978), chapter VII) can belong to the following classes of chemical substances: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivates containing esterified or etherified phenolic hydroxyl groups and metal complexes.

Compounds which contain both a sterically hindered amine partial structure and a sterically hindered phenol partial structure in one molecule (U.S. Pat. No. 4,268,593) are particularly effective for preventing impairment of yellow colour-forming agents as a consequence of the development of heat, moisture and light. Spiroindanes (JP-A-159 644/81) and chromanes substituted by hydroquinone diethers or monoethers (JP-A-89 835/80) are particularly effective for preventing impairment of purple-red colour-forming agents, in particular as a consequence of the action of light.

The layers of the photographic material can be hardened with the customary hardening agents. Suitable hardening agents are e.g. formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. Nos. 3,288,775, 2,732,303, GB-A-974 723 and GB-A-1 167 207), divinylsulphone compounds, 5-acetyl-1,3-diacryloylhexahydro-1,3,5-triazine and other compounds containing a reactive olefin bond (U.S. Pat. Nos. 3,635,718, 3,232,763 and GB-A-994 869); N-hydroxymethylphthalimide and other N-methylol compounds (U.S. Pat. Nos. 2,732,316 and 2,586,168); isocyanates (U.S. Pat. No. 3,103,437); aziridine compounds (U.S. Pat Nos. 3,017,280 and 2,983,611); acid derivatives (U.S. Pat. Nos. 2,725,294 and 2,725,295); compounds of the carbodiimide type (U.S. Pat. No. 3,100,704); carbamoylpyridinium salts (DE-A-22 25 230 and DE-A-24 39 551); carbamoyloxypyridinium compounds (DE-A-24 08 814); compounds with a phosphorus-halogen bond (JP-A-113 929/83); N-carbonyloximide compounds (JP-A-43353/81); N-sulphonyloximido compounds (U.S. Pat. No. 4,111,926), dihydroquinoline compounds (U.S. Pat. No. 4,013,468), 2-sulphonyloxypyridinium salts (JP-A-110 762/81), formamidinium salts (EP-A-0 162 308), compounds with two or more N-acyloximino groups (U.S. Pat. No. 4,052,373), epoxy compounds (U.S. Pat. No. 3,091,537) and compounds of the isoxazole type (U.S. Pat. Nos. 3,321,313 and 3,543,292); halogenocarboxyaldehydes, such as mucochloric acid; diaoxane derivates, such as dihydroxdioxane and dichlorodioxane; chlorodioxane; and inorganic hardening agents, such as chrome alum and zirconium sulphate.

The hardening can be effected in a known manner by adding the hardening agent to the casting solution for the layer to be hardened the layer to be hardened with a layer containing a hardening agent which is capable of diffusion.

The classes listed include slow-acting and fast-acting hardening agents and so-called immediate hardeners, which are particularly advantageous.

The hardening agents last mentioned, which react with gelatin very rapidly, are e.g. carbamoylpyridinium salts which are capable of reacting with free carboxyl groups of the gelatin, so that the latter react with free amino groups of the gelatin to form peptide bonds and to crosslink the gelatin.

EXAMPLE 1

A colour photography recording material for colour negative colour development was prepared (layer arrangement 1 A - comparison) by applying the following layers to a transparent layer support of cellulose triacetate in the sequence shown. The amounts stated in each case relate to 1 $m^2$. For the silver halide application, the corresponding amounts of $AgNO_3$ are stated. All the silver halide emulsions were stabilized with 0.1 g 4-hydroxy-6-methyl-1,3,3a,7-tetraazaindene per 100 g $AgNO_3$.

Layer arrangement 1 A (comparison)

Layer 1 (antihalo layer) black colloidal silver sol containing
- 0.2 g Ag
- 1.2 g gelatin
- 0.1 g UV absorber UV-1
- 0.2 g UV absorber UV-2
- 0.02 g tricresyl phosphtate (TCP)
- 0.03 g dibutyl phthalate (DBP)

Layer 2 (Mikrat intermediate layer)
- Mikrat silver bromide-iodide emulsion (0.5 mol % iodide; average grain diameter 0.07 μm) from
- 0.25 g $AgNO_3$, containing
- 1.0 g gelatin
- 0.05 g red mask RM-2
- 0.10 g TCP Layer 3 (1st red-sensitized layer, low sensitivity) red-sensitized silver bromide-iodide emulsion (5.5 mol % iodide; average grain diameter 0.22 μm) from
- 1.20 g $AgNO_3$, containing
- 1.15 g gelatin
- 0.52 g cyan coupler C-1
- 0.03 g red mask RM-1
- 0.04 g DIR coupler DIR-3
- 0.35 g TCP
- 0.25 g DBP Layer 4 (2nd red-sensitized layer, medium sensitivity) red-sensitized silver bromide-iodide emulsion (4.5 mol % iodide; average grain diameter 0.52 μm) from
- 1.62 g $AgNO_3$, containing
- 1.40 g gelatin
- 0.45 g cyan coupler C-2
- 0.02 g red mask RM-1
- 0.05 g DIR coupler DIR-1
- 0.30 g TCP
- 10 0.25 g DBP Layer 5 (3rd red-sensitized layer, high sensitivity) red-sensitized silver bromide-iodide emulsion (8.5 mol % iodide; average grain diameter 0.85 μm) from 1.53 g $AgNO_3$, containing
- 1.24 g gelatin
- 0.17 g cyan coupler C-3
- 0.03 red mask RM-2
- 0.10 g TCP
- 0.08 g DBP Layer 6 (intermediate layer)
- 0.8 g gelatin
- 0.05 g 2,5-di-t-pentadecylhydroquinone
- 0.05 g TCP
- 25 0.05 g DBP Layer 7 (1st green-sensitized layer, low sensitivity) green-sensitized silver bromide-iodide emulsion (5 mol % iodide; average grain diameter 0.23 μm) from
- 1.06 g $AgNO_3$, containing
- 0.85 g gelatin
- 0.36 g magenta coupler M-2
- 0.04 g yellow mask YM-2
- 0.04 g DIR coupler DIR-1

Layer 8 (2nd green-sensitized layer, medium sensitivity) green-sensitized silver bromide-iodide emulsion (4 mol % iodide; average grain diameter 0.45 μm) from
- 1.25 g $AgNO_3$, containing
- 1.05 g gelatin
- 0.38 g magenta coupler M-3
- 0.05 g yellow mask YM-2
- 0.04 g DIR coupler DIR-2
- 0.35 g TCP
- 0.15 g DBP Layer 9 (3rd green-sensitive layer, high sensitivity) green-sensitized silver bromide-iodide emulsion (9 mol % iodide; average grain diameter 0.82 μm) from
- 1.45 g $AgNO_3$, containing
- 1.1 g gelatin
- 0.15 g magenta coupler M-4
- 0.02 g yellow mask YM-3
- 0.10 g TCP
- 0.10 g DBP Layer 10 (yellow filter layer) yellow colloidal silver sol containing 0.04 g Ag, rendered passive with 6 mg 1-phenyl-5-mercaptotetrazole per g Ag
- 0.8 g gelatin
- 0.15 g 2,5-di-t-pentadecylhydroquinone
- 0.40 g TCP Layer 11 (1st blue-sensitive layer, low sensitivity) blue-sensitized silver bromide-iodide emulsion (4.5 mol % iodide; average grain diameter 0.28 μm) from
- 0.70 g $AgNO_3$, containing
- 1.2 g gelatin
- 0.9 g yellow coupler Y-1
- 0.20 g DIR coupler DIR-2
- 0.70 g TCP
- 0.20 g DBP Layer 12 (2nd blue-sensitive layer, medium sensitivity), blue-sensitized silver bromide-iodide emulsion (5 mol % iodide; average grain diameter 0.5 μm) from
- 0.4 g $AgNO_3$, containing
- 0.51 g yellow coupler Y-1
- 0.85 g gelatin
- 0.10 g DIR coupler DIR-2
- 0.40 g TCP
- 0.20 g DBP Layer 13 (3rd blue-sensitive layer, high sensitivity) blue-sensitized silver bromide-iodide emulsion (9.5 mol % iodide; average grain diameter 0.94 μm) from
0.81 g $AgNO_3$, containing
0.25 g yellow coupler Y-4
1.0 g gelatin
0.20 g TCP Layer 14 (protective and hardening layer) Mikrat silver bromide-iodide emulsion (0.5 mol % idodie; average grain diameter 0.04 μm) from
0.5 g $AgNO_3$, containing
0.5 g $AgNO_3$, containing
1.2 g gelatin
0.4 g hardening agent H-1
1.0 g formaldehyde collector FC In addition to the couplers already mentioned, the following compounds are used in example 1:

UV absorber UV-1

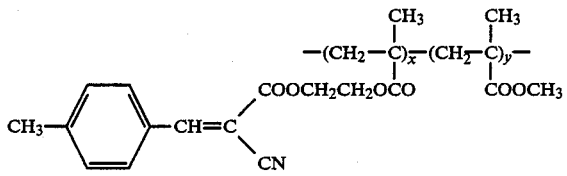

weight ratio: x:y = 7:3

UV-absorber UV-2

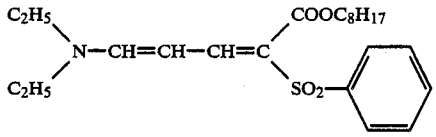

Formaldehyde collector FC

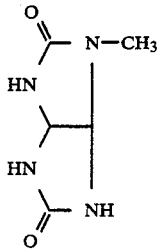

Hardening agent H-1

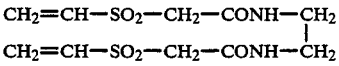

The following layer arrangements 1B, 1C, 1D and 1E were also prepared analogously.

Layer arrangement 1B (comparison):

As layer arrangement 1A, but with the following changes:

Layer 3:
no DIR coupler,
$AgNO_3$ application 0.82 g (instead of 1.20 g)

Layer 7:
no DIR coupler,
$AgNO_3$ application 0.66 g (instead of 1.06 g)

Layer 11:
no DIR coupler,
$AgNO_3$ application 0.52 g (instead of 0.70 g).

Layer arrangement 1C (comparison):

As layer arrangement 1A, but with the following changes:

Layer 3:
0.32 g coupler C-4 (fast)
(instead of 0.52 g coupler C-1 (slow))
0.028 g red mask RM-2 (fast)
(instead of 0.03 g red mask RM-1 (slow))
$AgNO_3$ application 0.93 g (instead of 1.20 g)

Layer 7:
0.24 g coupler M-6 (fast)
(instead of 0.36 g coupler M-2 (slow))
0.04 g yellow mask YM-3 (fast)
(instead of 0.04 g yellow mask YM-2 (slow))
$AgNO_3$ application 0.73 g (instead of 1.06 g)

Layer 11:
0.46 g coupler Y-6 (fast)
(instead of 0.51 g coupler Y-1 (slow))
$AgNO_3$ application 0.59 g (instead of 0.70 g)

Layer arrangement 1D (according to the invention):

As layer arrangement 1C, but with the following changes:

Layer 3:
no DIR coupler,
$AgNO_3$ application 0.50 g (instead of 0.93 g)

Layer 7:
no DIR coupler
$AgNO_3$ application 0.35 g (instead of 0.73 g)

Layer 11:
no DIR coupler
$AgNO_3$ application 0.32 g (instead of 0.59 g)

Layer arrangement 1E (according to the invention):

As layer arrangement 1D, but with the following changes:

Layer 5:
A additionally 0.022 g DIR coupler DIR-6
$AgNO_3$ application 1.76 g (instead of 1.53 g)

Layer 9:
additionally 0.019 g DIR coupler DIR-7
$AgNO_3$ application 1.63 g (instead of 1.45 g)

Layer 13:
additionally 0.016 g DIR coupler DIR-7
$AgNO_3$ application 1.06 g (instead of 0.81 g)

An overview of the most important features of the layer arrangements 1A to 1E is shown in Table 1a. All the layer arrangements 1A to 1E coincide in the following points:

1. The coupler couples fast in the high-sensitivity part layer.
2. The coupler couples slowly in the medium-sensitivity part layer.
3. The medium-sensitivity part layer contains a DIR coupler.

On the other hand, differences exist in the following points:

1. The low-sensitivity part layer contains no DIR coupler in the layer arrangements 1B, 1D and 1E.
2. The colourless coupler contained in the low-sensitivity part layer couples slowly in layer build-ups 1A and 1B and fast in layer buildups 1C, 1D and 1E.
3. The high-sensitivity part layer contains a DIR coupler only in layer arrangements 1E.

Table 1b gives an overview of the couplers, DIR couplers and mask couplers contained in the individual layers of the various layer arrangements. The relative coupling rate constant k is stated in units of $10^4.L.mol^{-1}.s^{-1}$ in parentheses. Table 1c gives an overview of the silver halide applications, in the form of the equivalent amounts of $AgNO_3$, contained in the individual layers of the various layer arrangements. The total application of $AgNO_3$ is also stated.

TABLE 1a

| | | (for example 1) Layer arrangements | | | | |
|---|---|---|---|---|---|---|
| | | (comparison) | | (according to the invention) | | |
| | | 1A | 1B | 1C | 1D | 1E |
| Low-sensitivity part Layers | coupler DIR coupler | slow with | slow without | fast with | fast without | fast without |
| medium-sensitivity part Layers | coupler DIR coupler | slow with | slow with | slow with | slow with | slow with |
| high-sensitivity part Layers | coupler DIR coupler | fast without | fast without | fast without | fast without | fast with |

TABLE 1b

| | Layer arrangements: 1A and 1B | | | Layer arrangements: 1C, 1D, 1E | | |
|---|---|---|---|---|---|---|
| Layer | Colour coupler | DIR coupler | Mask coupler | Colour coupler | DIR coupler | Mask coupler |
| 3 | C-1 (0.14) | 1A: DIR-3 (1.4) | RM-1 (0.8) | C-4 (7.0) | 1C: DIR-3 (1.4) | RM-2 (3.5) |
| 4 | C-2 (0.66) | DIR-1 (0.9) | RM-1 (0.8) | C-2 (0.66) | DIR-1 (0.9) | RM-1 (0.8) |
| 5 | C-3 (3.2) | — | RM-2 (3.5) | C-3 (3.2) | 1E: DIR-6 (2.8) | RM-2 (3.5) |
| 7 | M-2 (1.8) | 1A: DIR-1 (0.9) | YM-2 (1.4) | M-6 (7.0) | build-up 1C: DIR-1 (0.9) | YM-3 (3.0) |
| 8 | M-3 (1.9) | DIR-2 (1.1) | YM-2 (1.4) | M-3 (1.9) | DIR-2 (1.1) | YM-2 (1.4) |
| 9 | M-4 (4.3) | — | YM-3 (3.0) | M-4 (4.3) | 1E: DIR-7 (4.2) | YM-3 (3.0) |
| 11 | Y-1 (1.2) | 1A: DIR-2 (1.1) | — | Y-6 (7.0) | build-up 1C: DIR-2 (1.1) | — |
| 12 | Y-1 (1.2) | DIR-2 (1.1) | — | Y-1 (1.2) | DIR-2 (1.1) | — |
| 13 | Y-4 (4.4) | — | — | Y-4 (4.4) | 1E: DIR-7 (4.2) | |

TABLE 1c

| | $AgNO_3$ applications [g/m²] Layer arrangements | | | | |
|---|---|---|---|---|---|
| | (comparison) | | (according to the invention) | | |
| Layer | 1A | 1B | 1C | 1D | 1E |
| 1 | | | | | |
| 2 | | | | | |
| 3 | 1.20 | 0.82 | 0.93 | 0.50 | 0.50 |
| 4 | 1.62 | 1.62 | 1.62 | 1.62 | 1.62 |
| 5 | 1.53 | 1.53 | 1.53 | 1.53 | 1.76 |
| 6 | | | | | |
| 7 | 1.06 | 0.66 | 0.73 | 0.35 | 0.35 |
| 8 | 1.25 | 1.25 | 1.25 | 1.25 | 1.25 |
| 9 | 1.45 | 1.45 | 1.45 | 1.45 | 1.63 |
| 10 | | | | | |
| 11 | 0.70 | 0.52 | 0.59 | 0.32 | 0.32 |
| 12 | 0.40 | 0.40 | 0.40 | 0.40 | 0.40 |
| 13 | 0.81 | 0.81 | 0.81 | 0.81 | 1.06 |
| 14 | | | | | |
| Total | 10.02 | 9.06 | 9.31 | 8.23 | 8.89 |

One sample each of layer arrangement 1A to 1E was exposed to white light behind a grey step wedge (exposure time: 0.01 s) and processed by a colour negative processing process as described in "The British Journal of Photography", (1974), pages 597 and 598. The RMS values (=root mean square) were determined with a measurement aperture of 48 μm diameter at various colour densities as a measure of the colour grain. The measurement method is described in: T. H. James, The Theory of the Photographic Process, 4th ed., MacMillan Publ. Co., New York (1977) p. 619. Numerical values for the five layer arrangements 1A to 1E are given in Table 1d.

The modulation transfer function (MTF) was also determined of the five layer arrangements as a measure of the sharpness. This method is described e.g. by T. H. James, p. 604.

That site frequency ($\nu$ in [$mm^{-1}$]) at which the MTF still has a value of 50% is shown in Table 1d as a measure of the sharpness. The higher this value, the better the image sharpness.

It can be seen from this table that layer arrangements 1D and 1E according to the invention have a significantly better sharpness, in particular in the blue-green and purple-coloured part colour image, in comparison with the comparison build-ups 1A to 1C, without deterioration in the colour grain.

The photosensitivities were the same in the layer arrangements 1A to 1E within experimental variations (±0.2 DIN).

TABLE 1d

| | Colour grains and sharpness | Layer arrangement | | | | |
|---|---|---|---|---|---|---|
| | | (comparison) | | | (according to the invention) | |
| | Colour density over fog | A | B | C | D | E |
| Colour grain (RMS) yellow | 0.5 | 24.5 | 25 | 24.5 | 24.0 | 23.5 |
| | 1.0 | 23.0 | 23 | 23.0 | 23.0 | 22.5 |
| | 1.5 | 23.0 | 21.5 | 22.0 | 22.0 | 22.0 |
| Colour grain (RMS) purple | 0.5 | 10.0 | 10.5 | 10.0 | 10.0 | 9.5 |
| | 1.0 | 9.5 | 9.5 | 9.0 | 9.0 | 8.5 |
| | 1.5 | 12.0 | 13.5 | 8.0 | 8.0 | 8.0 |
| Colour grain (RMS) blue-green | 0.5 | 9.3 | 9.4 | 9.2 | 9.0 | 8.5 |
| | 1.0 | 9.8 | 10.8 | 7.4 | 7.5 | 7.5 |
| | 1.5 | 9.8 | 11.2 | 6.8 | 7.0 | 7.0 |
| site frequency $\nu$ [$mm^{-1}$], for MTF = 50% | colour: yellow | 70 | 70 | 72 | 80 | 78 |
| | magenta | 52 | 58 | 55 | 72 | 68 |
| | cyan | 28 | 36 | 34 | 45 | 42 |

EXAMPLE 2

Layer arrangements 2A to 2E were prepared with the same qualitative gradiations in coupling rates as described in Table 1a (example 1), but with a different layer sequence, using the couplers, DIR couplers and mask couplers shown in Table 2b (the relative coupling rate constant k is stated in parentheses) and the $AgNO_3$ applications shown in Table 2c. Layers 3–5 in example 1 correspond to the red-sensitive layers 3, 4 and 11, layers 7–9 in example1 correspond to the green-sensitive layers 6, 7 and12, and instead of the blue-sensitive layers 11–13 present in example 1, the layer arrangements of example 2 contain only the layers 9 and 15. Layers 5, 10 and 12 are intermediate layers and have the same composition as layer 6 in example 1. Layers 8 and 14 are yellow filter layers; each of these has the same composition as layer 10 in example 1, but contains only half as much silver sol and TCP.

Table 2a gives an overview of the couplers, DIR couplers and mask couplers contained in the individual layers of the various layer arrangements. The relative coupling rate constant k is stated in units of $10^4.L.mol^{-1}.s^{-1}$ in parentheses. Table 2b gives an overview of the silver halide applications, in the form of equivalent amounts of $AgNO_3$, contained in the individual layers of the various layer arrangements. The total application of $AgNO_3$ is also stated.

TABLE 2a

| | Layer arrangements: 2A and 2B | | | Layer arrangements: 2C, 2D, 2E | | |
|---|---|---|---|---|---|---|
| Layer | Colour coupler | DIR coupler | Mask coupler | Colour coupler | DIR coupler | Mask coupler |
| 3 | C-3 (3.2) | arrangement 2A: DIR-3 (1.4) | — | C-6 (2.75) | arrangement 2C: DIR-3 (1.4) | |
| 4 | C-3 (3.2) | DIR-6 (2.8) | RM-2 (3.5) | C-3 (3.2) | DIR-6 (2.8) | RM-2 (3.5) |
| 6 | M-1 (1.4) | arrangement 2A: DIR-1 (0.9) | YM-1 (1.2) | M-7 (13.0) | arrangement 2C: DIR-1 (0.9) | YM-3 (3.0) |
| 7 | M-1 (1.4) | DIR-4 (1.5) | YM-1 (1.2) | M-1 (1.4) | DIR-4 (1.5) | YM-1 (1.2) |
| 9 | Y-2 (1.2) | DIR-1 (0.9) | — | Y-2 (1.2) | DIR-1 (0.9) | — |
| 11 | C-5 (8.5) | — | RM-2 (3.5) | C-5 (8.5) | arrangement 2E: DIR-8 (5.0) | RM-2 (3.5) |
| 13 | M-5 (6.7) | — | YM-3 (3.0) | M-5 (6.7) | arrangement 2E: DIR-8 (5.0) | YM-3 (3.0) |
| 15 | Y-3 (2.8) | — | — | Y-3 (2.8) | arrangement 2E: DIR-5 (1.5) | — |

TABLE 2b

| | $AgNO_3$ applications [g/m²] Layer arrangements | | | | |
|---|---|---|---|---|---|
| | (comparison) | | (according to the invention) | | |
| Layer | 2A | 2B | 2C | 2D | 2E |
| 3 | 1.26 | 0.78 | 0.90 | 0.45 | 0.45 |
| 4 | 1.55 | 1.55 | 1.55 | 1.55 | 1.55 |
| 6 | 1.02 | 0.71 | 0.82 | 0.42 | 0.42 |
| 7 | 0.96 | 0.96 | 0.96 | 0.96 | 0.96 |
| 9 | 0.65 | 0.65 | 0.65 | 0.65 | 0.65 |
| 11 | 1.47 | 1.47 | 1.47 | 1.47 | 1.62 |
| 13 | 1.18 | 1.18 | 1.18 | 1.18 | 1.35 |
| 15 | 0.91 | 0.91 | 0.91 | 0.91 | 1.15 |
| Total | 9.00 | 8.21 | 8.44 | 7.59 | 8.15 |

Details of layer build-ups 2A to 2E are given

Preparation of layer arrangements 2A to 2E

Layer support, amounts and stabilization of the emulsions and layers 1 and 2 as described in example 1.

Layer arrangement 2A (comparison)

Layer 3 (1st red-sensitive layer, low sensitivity) red-sensitized silver chloride-bromide-iodide emulsion (1.3 mol % iodide; average grain diameter 0.26 μm) from
1.26 g $AgNO_3$, containing
1.42 g gelatin
0.48 g cyan coupler C-3
0.05 g DIR coupler DIR-3
0.30 g TCP
0.20 g DBP Layer 4 (2nd red-sensitive layer, medium sensitivity) red-sensitized silver chloride-bromide-iodide emulsion (1.0 mol % chloride, 2.5 mol % iodide; average grain diameter 0.55 μm) from
1.55 g $AgNO_3$, containing
1.35 g gelatin
0.38 g cyan coupler C-3
0.03 g red mask RM-2
0.045 g DIR coupler DIR-6
0.25 g TCP
0.20 g DBP Layer 5 (intermediate layer) as layer 6 from example 1

Layer 6 (1st green-sensitive layer, low sensitivity) green-sensitized silver chloride-bromide-iodide emulsion (1.8 mol % chloride, 3.0 mol % iodide; average grain diameter 0.26 μm) from
1.02 g $AgNO_3$, containing
1.00 g gelatin
0.32 g magenta coupler M-1
0.03 g yellow mask YM-1
0.04 g DIR coupler DIR-1
0.25 g TCP
0.22 g DBP Layer 7 (2nd green-sensitive layer, medium sensitivity) green-sensitized silver chloride-bromide-iodide emulsion (0.5 mol % chloride, 2.8 mol % iodide; average grain diameter 0.52 μm) from
0.96 g $AgNO_3$, containing
0.82 g gelatin
0.26 g magenta coupler M-1
0.05 g yellow mask YM-1
0.03 g DIR coupler DIR-4
0.25 g TCP
0.12 g DBP Layer 8 (yellow filter layer) yellow colloidal silver sol, rendered passive with 6 mg 1-phenyl-5-mercaptotetrazole per 1 g Ag
0.02 g Ag 0.8 g gelatin
0.15 g 2,5-di-t-pentadecylhydroquinone
0.20 g TCP Layer 9 (1st blue-sensitive layer, low sensitivity) blue-sensitized silver bromide-iodide emulsion (4.5 mol % iodide; average grain diameter 0.45 μm) from
0.65 g $AgNO_3$, containing
1.20 g gelatin
0.90 g yellow coupler Y-2
0.15 g DIR coupler DIR-1
0.80 g TCP
0.50 g DBP Layer 10 (intermediate layer) as layer 5

Layer 11 (3rd red-sensitive layer, high sensitivity) red-sensitized silver bromide-iodide emulsion (9.2 mol % iodide; average grain diameter 0.96 μm) from 1.47 g $AgNO_3$, containing
1.30 g gelatin
0.12 g cyan coupler C-5
0.01 g red mask RM-2
0.10 g TCP
0.05 g DBP Layer 12 (intermediate layer) as layer 5

Layer 13 (3rd green-sensitive layer, high sensitivity) green-sensitized silver bromide-iodide emulsion (9.5 mol % iodide; average grain diameter 0.95 μm) from
1.18 g $AgNO_3$, containing
1.05 g gelatin
0.14 g magenta couple M-5
0.01 g yellow mask YM-3
0.12 g TCP
0.05 g DBP Layer 14 (yellow filter layer) as layer 8

Layer 15 (2nd blue-sensitive layer, high sensitivity) blue-sensitized silver chloride-bromide-iodide emulsion (0.8 mol % chloride, 10.5 mol % iodide; average grain diameter 1.1 μm) from
0.91 g $AgNO_3$, containing
0.79 g gelatin
0.12 g yellow coupler Y-3
0.10 g TCP Layer 16 (protective and hardening layer) Mikrat silver bromide-iodide emulsion (2.0 mol % iodide; average grain diameter 0.08 μm) from
0.4 g $AgNO_3$, containing
1.0 g gelatin
0.5 g hardening agent [CAS reg. no. 65411-60-1]
0.8 g fomaldehyde collector FC The following layer build-ups 2B, 2C, 2D and 2E were also prepared analogously.

Layer arrangement 2B (comparison):

As layer arrangement 2A, but with the following changes:

Layer 3:
no DIR coupler,
$AgNO_3$ application 0.78 g (instead of 1.26 g)

Layer 6:
no DIR coupler,
$AgNO_3$ application 0.71 g (instead of 1.02 g)

Layer arrangement 2C (comparison):

As layer arrangement 2A, but with the following changes:

Layer 3:
0.30 g cyan coupler C-6 (fast)
(instead of 0.48 g cyan coupler C-3 (slow))
$AgNO_3$ application 0.90 g (instead of 1.26 g)

Layer 6:
0.28 g magenta coupler M-7 (fast)
(instead of 0.32 g magenta coupler M-1 (slow))
0.03 g yellow mask YM-3 (fast)
(instead of 0.03 g yellow mask YM-1 (slow))
$AgNO_3$ application 0.82 g (instead of 1.02 g)

Layer arrangement 2D (according to the invention):

As layer arrangement 2C, tut with the following changes:

Layer 3:
no DIR coupler,
$AgNO_3$ application 0.45 g (instead of 0.90 g)

Layer 6:
no DIR coupler,
$AgNO_3$ application 0.42 g (instead of 0.82 g)

Layer arrangement 2E (according to the invention):

As layer arrangement 20, but with the following changes:

Layer 11:
additionally 0.015 g DIR coupler DIR-8 $AgNO_3$ application 1.62 g (instead of 1.47 g)

Layer 13:
additionally 0.018 g DIR coupler DIR-8 $AgNO_3$ application 1.35 g (instead of 1.18 g)

Layer 15:
additionally 0.02 g DIR coupler DIR-5 $AgNO_3$ application 1.15 g (instead of 0.91 g)

The samples were processed and the colour grain and sharpness (i.e. the MTF values) were determined as described for example 1.

The values found for the colour grains and for the sharpness of layer arrangements 2A to 2E are shown in Tablie 2c.

The sharpness is improved, above all in the cyan and magenta, by the measures according to the invention, without a deterioration in the colour grain.

The sensitivities were the same for layer arrangements 2A to 2E, within the experimental variations (±0.2 DIN).

TABLE 2c

| | Colour grains and sharpness | | | | | |
|---|---|---|---|---|---|---|
| | | Layer arrangement | | | | |
| | Colour density over fog | (comparison) | | | (according to the invention) | |
| | | A | B | C | D | E |
| Colour grain (RMS) yellow | 0.5 | 29.5 | 19.5 | 19.5 | 19.5 | 18.0 |
| | 1.0 | 21.0 | 21.0 | 21.0 | 21.0 | 20.5 |
| | 1.5 | 22.5 | 22.5 | 22.5 | 22.5 | 22.5 |
| Colour grain (RMS) purple | 0.5 | 9.0 | 9.5 | 9.0 | 9.0 | 8.5 |
| | 1.0 | 8.5 | 8.5 | 8.0 | 8.0 | 8.8 |
| | 1.5 | 7.0 | 8.0 | 7.0 | 7.0 | 7.0 |
| Colour grain (RMS) blue-green | 0.5 | 8.5 | 9.0 | 8.5 | 8.5 | 8.0 |
| | 1.0 | 7.5 | 8.0 | 7.5 | 7.5 | 7.0 |
| | 1.5 | 7.5 | 8.5 | 7.0 | 6.5 | 6.5 |
| site frequency $\nu$ [$mm^{-1}$], for MTF = 50% | colour: | | | | | |
| | yellow | 82 | 82 | 82 | 82 | 82 |
| | magenta | 53 | 57 | 54 | 65 | 63 |
| | cyan | 32 | 42 | 38 | 54 | 50 |

EXAMPLE 3

Layer arrangements 3A (comparison) and 3B and 3C (according to the invention) described below were prepared with the qualitative gradations in the coupling rates shown in Table 3a.

Layer support, amounts and stabilization of the emulsions and layers 1, 2, 6 and 10 are as described in example 1.

Layer arrangement 3A (comparison)

The layer carrier and layers 1 and 2 are as for layer build-up 1A.

Layer 3 (1st red-sensitized layer, low sensitivity) red-sensitized silver bromide-iodide emulsion (6.5 mol % iodide; average grain diameter 0.25 μm) from
0.38 g $AgNO_3$, containing
0.90 g gelatin
0.20 g cyan coupler C-7
0.05 g red mask RM-2
0.20 g DBP Layer 4 (2nd red-sensitized layer, medium sensitivity) red-sensitized silver bromide-iodide emulsion: (4.8 mol % iodide; average grain diameter 0.45 μm) from
1.50 g $AgNO_3$, containing
1.40 g gelatin
0.45 g cyan coupler C-2
0.02 g red mask RM-1
0.05 g DIR coupler DIR-1
0.30 g TCP
0.25 g DBP Layer 5 (3rd red-sensitized layer, high sensitivity) red-sensitized silver bromide-iodide emulsion (8.0 mol % iodide; average grain diameter 0.90 μm) from 1.45 g $AgNO_3$, containing
0.95 g gelatin
0.15 g cyan coupler C-2
0.03 g red mask RM-1
0.10 g TCP
0.08 g DBP Layer 7 (1st green-sensitized layer, low sensitivity) green-sensitized silver bromide-iodide emulsion (5 mol % iodide; average grain diameter 0.23 μm) from
0.25 g $AgNO_3$, containing
0.85 g gelatin
0.36 g magenta coupler M-2

Layer 8 (2nd green-sensitized layer, medium sensitivity) green-sensitized silver bromide-iodide emulsion-(4 mol % iodide; average grain diameter 0.45 μm) from
0.70 g $AgNO_3$, containing
1.05 g gelatin
0.38 g magenta coupler M-1
0.05 g yellow mask YM-1
0.04 g DIR coupler DIR-2
0.35 g TCP
0.15 g DBP Layer 9 (3rd third green-sensitive layer, high sensitivity) green-sensitized silver bromide-iodide emulsion (9 mol % iodide; average grain diameter 0.82 μm) from
1.40 g $AgNO_3$, containing
1.1 g gelatin
0.15 g magenta coupler M-1
0.02 g yellow mask YM-1
0.10 g TCP
0.10 g DBP Layer 11 (blue-sensitive layer) Emulsion mixture of
(a.) a blue-sensitized silver chloride-bromide-iodide emulsion (2.5 mol % chloride, 4.5 mol % iodide; homodisperse; grain diameter 0.25 μm) from 0.65 g $AgNO_3$, and
(b.) a blue-sensitized silver bromide emulsion (9.5 mol % iodide; homodisperse; grain diameter 0.82 μm) from 0.55 g $AgNO_3$, containing
1.0 g gelatin
1.95 g yellow coupler Y-8
0.20 g DIR coupler DIR-7
0.70 g TCP
0.20 g DBP Layer 12 (protective and hardening layer) as layer 14 of layer build-up 1A Layer arrangement 38 (according to the invention)

As arrangement 3A, but with the following changes:

Layer 5:
0.12 g coupler C-5
(instead of 0.15 g coupler C-2)
0.03 g red mask RM-2
(instead of 0.03 g red mask RM-1)

Layer 9:
0.10 g coupler M-5
(instead of 0.15 g coupler M-1)
0.02 g yellow mask YM-3
(instead of 0.02 g yellow mask YM-1)

Layer arrangement 3C (according to the invention)

As later arrangement 3A, but with the following changes:

Layer 5:
0.05 g coupler C-5 and
0.10 g coupler C-2
(instead of 0.15 g coupler C-2)
0 03 g red mask RM-2
(instead of 0.03 g red mask RM-1)

Layer 9:
0.075 g coupler M-5 and
0.075 g coupler M-1
(instead of 0.15 g coupler M-1)
0.02 g yellow mask YM-3
(instead of 0.02 g yellow mask YM-1)

Table 3b gives an overview of the couplers, DIR couplers and mask couplers contained in the individual layers of layer arrangements 3A and 3B. The relative coupling rate constant k is stated in units of $10^4.L.mol^{-1}.s^{-1}$ in parantheses.

Samples of layer arrangements 3A, 3B and 3C were processed and the colour grain and sharpness (i.e. the MTF values) were determined as described for example 1.

Table 3d shows the values found for the colour grains and for the sharpness of layer arrangements 3A, 3B and 3C, as well as the photographic sensitivities.

It can be seen from Table 3c that, for the same sharpness, the colour grains and sensitivities in the cyan and magenta are improved in materials 3B and 3C according to the invention in comparison with comparison layer arrangement 3A.

TABLE 3a (for example 3)

| Layers in Bg and Pp | | Layer arrangements (comparison) 3A | (according to the invention) 3B | 3C |
|---|---|---|---|---|
| Low sensitivity | coupler | fast | fast | fast |
| | DIR | without | without | without |
| | coupler | | | |
| medium sensitivity | coupler | slow | slow | slow |
| | DIR | with | with | with |
| | coupler | | | |
| high sensitivity | coupler | slow | fast | fast + slow mixed |
| | DIR | without | without | without |

TABLE 3a-continued

| Layers in Bg and Pp | (for example 3) Layer arrangements (comparison) 3A | (according to the invention) 3B | 3C |
|---|---|---|---|
| coupler | | | |

TABLE 3b

| Layer | Layer arrangement 3A (comparison) Colour coupler | DIR coupler | Mask coupler | Layer arrangement 3B (according to the invention) Colour coupler | DIR coupler | Mask coupler |
|---|---|---|---|---|---|---|
| 3 | C-7 (7.2) | — | RM-2 (3.5) | | as 3A | |
| 4 | C-2 (0.66) | DIR-1 (0.9) | RM-1 (0.8) | | as 3A | |
| 5 | C-2 (0.66) | — | RM-1 (0.8) | C-5 (8.5) | — | RM-2 (3.5) |
| 7 | M-5 (6.7) | — | | | as 3A | |
| 8 | M-1 (1.4) | DIR-2 (1.1) | YM-1 (1.2) | | as 3A | |
| 9 | M-1 (1,4) | — | YM-1 (1.2) | M-5 (6.7) | — | YM-3 (3.0) |
| 11 | Y-6 (7.0) | DIR-7 (4.2) | | | as 3A | |

TABLE 3c

| | Colour grains, sharpness and sensitivities (blue-green and purple) Colour density over fog | Layer arrangement 3A (comparison) | 3B (according to the invention) | 3C (according to the invention) |
|---|---|---|---|---|
| Colour grain | 0.5 | 16 | 10 | 12 |
| (RMS) | 1.0 | 13 | 9 | 10 |
| purple | 1.5 | 11 | 8 | 9 |
| Colour grain | 0.5 | 15 | 10 | 11 |
| (RMS) | 1.0 | 12 | 8.5 | 9 |
| blue-green | 1.5 | 10 | 8 | 8 |
| Sharpness: | | | | |
| site frequency | colour: | | | |
| $\nu$ [$mm^{-1}$], | magenta | 71 | 72 | 71 |
| for MTF = 50% | cyan | 42 | 43 | 43 |
| Sensitivity | magenta | 20.2 | 21.7 | 21.5 |
| [DIN] | cyan | 19.8 | 21.6 | 21.5 |

We claim:

1. A color photographic negative recording material containing at least one red-sensitive, at least one green-sensitive and at least one blue-sensitive silver halide emulsion layer each with assigned color couplers for producing image dyestuffs of complementary color to the spectral sensitivity, at least three part layers of different sensitivity being present for recording light from at least one of the spectral ranges of red, green and blue, that is to say a most sensitive, a medium-sensitive and a least sensitive part layer, at least one of the two more sensitive part layers of which contains a DIR compound, characterized in that the most sensitive and the least sensitive part layer contain a color coupler which couples faster than the color coupler in the medium-sensitive part layer by a factor of at least 1.5.

2. Recording material as claimed in claim 1, wherein the least sensitive part layer contains no DIR compound.

3. Recording material as claimed in any of claim 1, wherein the DIR compound contained in one of the two more sensitive part layers is a DIR coupler.

4. Recording material as claimed in claim 3, wherein the DIR coupler contained in one of the two more sensitive part layers differs in coupling rate from the colour coupler contained in the same part layer by a factor of not more than 5.

5. Recording material as claimed in claim 1, wherein the total silver halide coating weight of all the photosensitive layers, expressed by the equivalent amount of $AgNO_3$, is not more than 10 g $AgNO_3$ per $m^2$.

* * * * *